US008931510B2

(12) United States Patent
Gaertner et al.

(10) Patent No.: US 8,931,510 B2
(45) Date of Patent: Jan. 13, 2015

(54) RAIL VEHICLE WITH FILL LEVEL MONITORING OF A WASTEWATER TANK

(75) Inventors: Ralph Gaertner, Brueggen (DE); Torge Kamphausen, Willich (DE); Walter Lindermuth, Nieukerk (DE)

(73) Assignee: Siemens Aktiengesellschaft, Munich (DE)

( * ) Notice: Subject to any disclaimer, the term of this patent is extended or adjusted under 35 U.S.C. 154(b) by 99 days.

(21) Appl. No.: 13/504,998

(22) PCT Filed: Oct. 27, 2010

(86) PCT No.: PCT/EP2010/066268

§ 371 (c)(1),
(2), (4) Date: Apr. 30, 2012

(87) PCT Pub. No.: WO2011/051345

PCT Pub. Date: May 5, 2011

(65) Prior Publication Data

US 2012/0222758 A1 Sep. 6, 2012

(30) Foreign Application Priority Data

Oct. 30, 2009 (DE) ..... 10 2009 051 351

(51) Int. Cl.
*B60K 15/06* (2006.01)
*B61D 35/00* (2006.01)

(52) U.S. Cl.
CPC ..... *B61D 35/007* (2013.01)
USPC ..... 137/572; 137/389; 137/395; 4/340; 4/415; 4/665

(58) Field of Classification Search
USPC ..... 137/255, 256, 345, 347, 386, 389, 390, 137/391, 393, 395, 392, 205, 571, 572, 137/87.01, 87.02; 4/340, 415, 321, 665
See application file for complete search history.

(56) References Cited

U.S. PATENT DOCUMENTS

| | | | | | |
|---|---|---|---|---|---|
| 784,046 | A | * | 3/1905 | Hodgkin | 137/101.25 |
| 1,173,709 | A | * | 2/1916 | Claussen | 137/391 |
| 2,578,347 | A | * | 12/1951 | Gagnaire | 137/571 |
| 2,612,180 | A | * | 9/1952 | Schwarzkopf | 137/392 |
| 2,859,760 | A | * | 11/1958 | Borell | 137/392 |
| 3,049,887 | A | * | 8/1962 | Sharp et al. | 137/392 |
| 3,441,048 | A | * | 4/1969 | Finnegan | 137/392 |

(Continued)

FOREIGN PATENT DOCUMENTS

| | | | |
|---|---|---|---|
| CN | 101007535 | A | 8/2007 |
| DE | 2543250 | A1 | 4/1976 |

(Continued)

*Primary Examiner* — Craig Schneider
*Assistant Examiner* — Craig J Price
(74) *Attorney, Agent, or Firm* — Laurence A. Greenberg; Werner H. Stemer; Ralph E. Locher

(57) ABSTRACT

A rail vehicle contains a sanitary system which has a waste water tank and a fresh water tank which are each equipped with associated filling level sensors. A control device is provided for establishing a link in terms of control between the filling levels in the fresh water tank and waste water tank. The control device monitors the filling level in the waste water tank by associated sensors and controls the filling level in the fresh water tank as a function of a measured filling level in the waste water tank.

11 Claims, 2 Drawing Sheets

(56) References Cited

U.S. PATENT DOCUMENTS

| | | | | | |
|---|---|---|---|---|---|
| 3,817,274 | A | * | 6/1974 | Anderson | 137/392 |
| 4,660,586 | A | * | 4/1987 | Knapp et al. | 137/392 |
| 4,819,279 | A | * | 4/1989 | Sigler et al. | 4/321 |
| 4,844,117 | A | * | 7/1989 | Sung | 137/386 |
| 4,859,375 | A | * | 8/1989 | Lipisko et al. | 137/209 |
| 5,671,603 | A | * | 9/1997 | McCorkle et al. | 137/392 |
| 5,792,343 | A | * | 8/1998 | Fujita et al. | 137/101.25 |
| 6,026,837 | A | * | 2/2000 | Chen | 137/389 |
| 7,650,652 | B2 | * | 1/2010 | Schuster et al. | 4/415 |
| 2005/0274656 | A1 | * | 12/2005 | McKinney | 137/101.25 |
| 2010/0050330 | A1 | * | 3/2010 | Earlywine | 4/321 |

FOREIGN PATENT DOCUMENTS

| | | | |
|---|---|---|---|
| EP | 0295508 | A1 | 12/1988 |
| RU | 2208537 | C2 | 7/2003 |
| WO | 97/46435 | A1 | 12/1997 |

* cited by examiner

RAIL VEHICLE WITH FILL LEVEL MONITORING OF A WASTEWATER TANK

BACKGROUND OF THE INVENTION

Field of the Invention

The invention relates to a rail vehicle having a sanitary system, which comprises a wastewater tank and a freshwater tank, which are each equipped with assigned fill level sensors.

Monitoring the fill levels of the wastewater tank and the freshwater tank of a sanitary system in order to be able to take it out of operation if needed is known in the prior art. It is taken out of operation in particular if a fill level of 95% is reached in the wastewater tank or an empty signal occurs for the freshwater tank.

In rail vehicles, the general object consists of keeping the vehicle weight or the vehicle mass as low as possible. This is because a fundamental vehicle mass determines the dimensioning of fuel reserves, which are also to be kept as small as possible. Currently, the freshwater tank and the wastewater tank are each included as 100% filled in the calculation of the vehicle mass for the calculation of the fuel reserves, which therefore results in elevated fuel reserves.

BRIEF SUMMARY OF THE INVENTON

Proceeding therefrom, the invention is based on the object of refining the sanitary system in a rail vehicle in such a manner that a lower vehicle mass for the calculation of the fuel reserves can be specified for the unit made of freshwater tank and wastewater tank.

This object is achieved in that a control device is provided for the control linkage between the fill levels in the freshwater tank and the wastewater tank, the control device monitoring the fill level in the wastewater tank with the aid of associated sensors and, as a function of a detected fill level in the wastewater tank, controlling the fill level in the freshwater tank.

The provided linkage between the fill levels in the freshwater tank, on the one hand, and the wastewater tank, on the other hand, allows the total filling quantity in the water tanks of the sanitary system to be controlled so that, for example, a predefined maximum value for the total filling of the freshwater and wastewater tanks is not exceeded. It is therefore possible to have this maximum value incorporated into the calculation of the vehicle mass.

The monitoring of the fill level of the wastewater tank can be performed in various ways, for example continuously, cyclically, or upon reaching a predetermined limiting value for the fill level in the wastewater tank. Independently of the type of the monitoring of the fill level in the wastewater tank, the control device can lock filling lines of the freshwater tank upon reaching a predetermined fill level in the wastewater tank. It is thus ensured that the freshwater tank is not brought by filling to such a fill level that the quantity of water located in the freshwater tank can no longer be accommodated by the wastewater tank. It is particularly important to avoid the case that, for example, the wastewater tank is already 95% filled and nonetheless the freshwater tank is completely filled in a new filling procedure.

Locking of the filling lines of the freshwater tank can be performed in various ways: The filling is performed equipped with the aid of a filling stop socket or solenoid valves are provided in the course of the filling lines, using which the filling lines can be blocked. A combination of these two procedures is also possible. In both cases, the control device processes the signals of the active components, namely the filling stop socket or solenoid valves, so that the desired locking of the filling lines is achieved.

In a further embodiment of the invention, it can also be provided that the control device empties the freshwater tank, as a function of a fill level of the wastewater tank, via an outlet or overflow line. This embodiment goes beyond the above-explained embodiment in that not only is further filling of the freshwater tank avoided, but rather the fill level of the freshwater tank is adapted to that of the wastewater tank. This adaptation advantageously occurs in such a manner that the control device empties the freshwater tank to such a fill level that the remaining freshwater can be accommodated by the wastewater tank.

In further embodiments, a fill level of the wastewater tank can be signaled generally. It can be provided that the fill level sensor of the wastewater tank is connected to a display device on a rail vehicle outer side, the display device then being used as the output device for current status messages of the fill level sensor. Alternatively or additionally, the fill level sensor can also be connected to a diagnostic device of the rail vehicle, to which the current status messages are signaled. In the first mentioned alternative, the displayed status message can be reacted to manually as needed, while in the second case the diagnostic device can automatically derive measures from the signaled status message about the fill level of the wastewater tank.

Exemplary embodiments of the invention will be explained in greater detail hereafter with reference to the drawings. In the figures:

DESCRIPTION OF THE INVENTION

Figure 1:
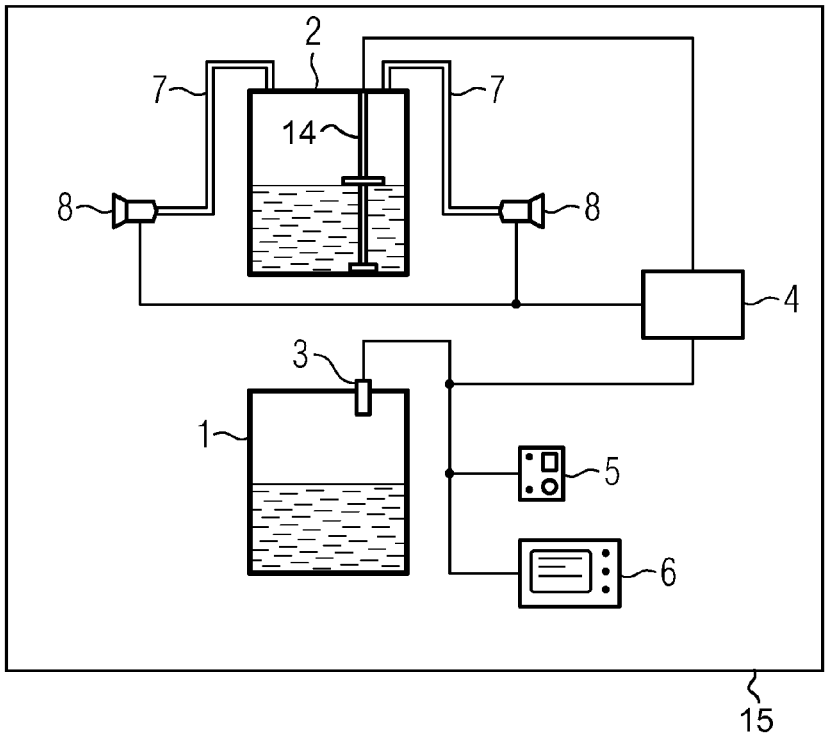
FIG. 1 shows a block diagram view of a sanitary system of a rail vehicle in a first embodiment.

The illustration of FIG. 1 shows essential components of a sanitary system of a rail vehicle 15, in particular a wastewater tank 1 and a freshwater tank 2. The wastewater tank 1 is equipped with a fill level sensor. The fill level sensor 3 of the wastewater tank 1 has a signaling connection to a control device 4, which controls a fill level of the freshwater tank 2 as a function of a currently detected measured value for the fill level of the wastewater tank 1. The freshwater tank 2 also has a fill level sensor 14.

In addition, current measured values from the fill level sensor 3 of the wastewater tank 1 are also supplied to a display device 5 attached to the vehicle outer side and a vehicle diagnostic device 6. The display device 5 can also be designed as a simple indicator light, which solely indicates that a limiting value for the fill level in the wastewater tank 1 has been exceeded.

The fill level in the wastewater tank 1 is monitored continuously, cyclically, or upon reaching a limiting value, specifically with the aid of the fill level sensor 3 in combination with the control device 4.

In FIG. 1, the freshwater tank 2 is provided with two filling lines 7, on the respective end of which a connecting piece having a filling stop socket 8 is used. The filling stop sockets 8 are activated by the control device 4 as needed so that further filling of the freshwater tank is effectively prevented, i.e., the fill level of the freshwater tank 2 cannot increase further. The control device 4 triggers the closing of the filling lines 7 when a predefined fill level is reached in the wastewater tank 1.

Figure 2:
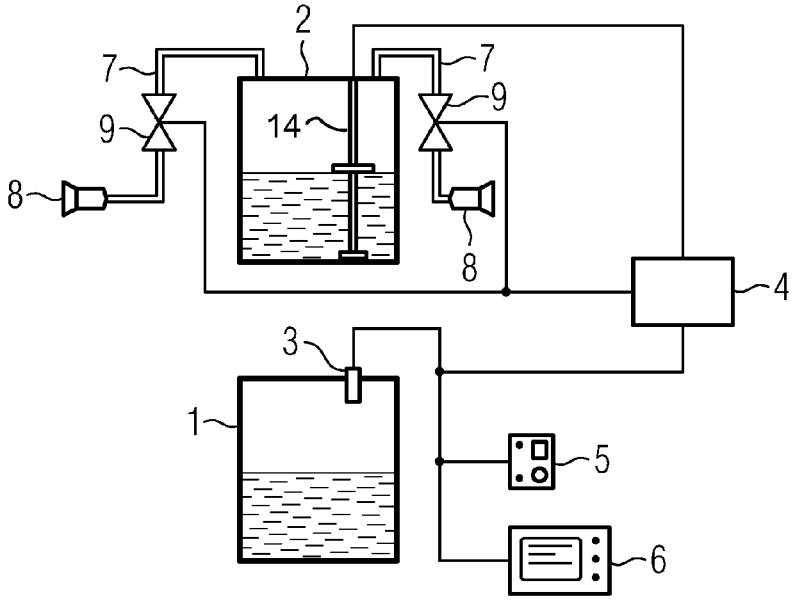
FIG. 2 shows a block diagram view of a sanitary system of a rail vehicle in a second embodiment.

The embodiment according to FIG. 2 differs from that according to FIG. 1 in that, instead of the filling stop sockets 8 in the respective course of the filling lines 7, solenoid valves 9 are provided, which are again activated by the control device 4 as needed so that further filling of the freshwater tank 2 is suppressed.

The two embodiments of the sanitary system for a rail vehicle presented on the basis of FIGS. 1 and 2 have the effect that the further filling 7 of the freshwater tank 2 is locked. The embodiments explained hereafter on the basis of FIGS. 3 and 4 go beyond the simple locking of the current fill level in the freshwater tank 2. In the embodiments described therein, the fill level in the freshwater tank 2 is actively affected. This means that, upon reaching a predetermined fill level in the wastewater tank 1, signaled by the fill level sensor 3, the control device 4 causes metered emptying of the freshwater tank 2.

Figure 3:
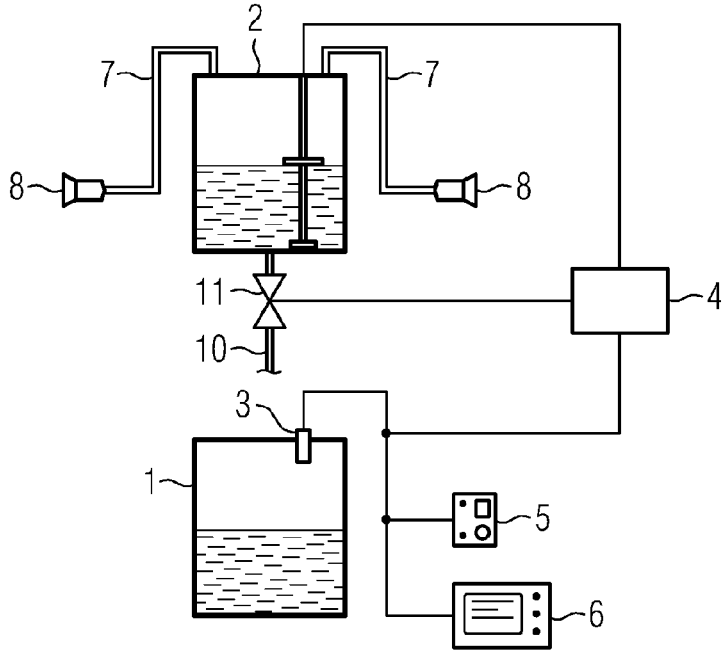
FIG. 3 shows a block diagram view of a sanitary system of a rail vehicle in a third embodiment.

This can be performed according to an embodiment according to FIG. 3 in such a manner that a predefined frost emptying line 10 is used for the metered emptying of the freshwater tank 2. In the embodiment according to FIG. 3, the control device 4 activates a solenoid valve 11 in such a manner that the fill level in the freshwater tank 2 is decreased with increasing fill level in the wastewater tank 1. The control target is pursued overall that the freshwater tank is emptied to such a fill level that the remaining freshwater can be accommodated by the wastewater tank 1. This is achieved by the control device 4 by suitable activation of the solenoid valve 11.

Figure 4:
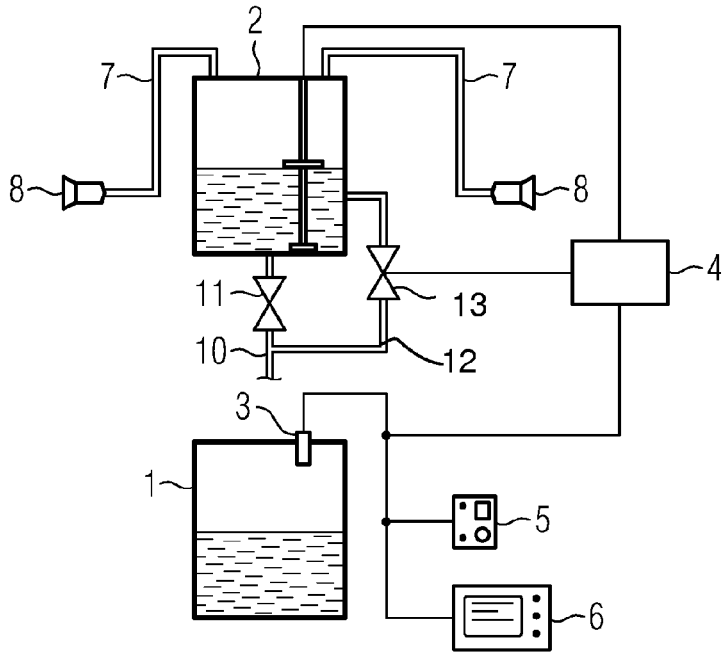
FIG. 4 shows a block diagram view of a sanitary system of a rail vehicle in a fourth embodiment.

In the embodiment according to FIG. 4, an additional bypass line 12 is provided, which has a further solenoid valve 13 and reaches from an interior of the freshwater tank 2 to a point of the frost emptying line beyond the solenoid valve 11. The control device 4 is connected to the further solenoid valve 12, which is activated in the same manner as the solenoid valve 11 used in FIG. 3 and fulfills the same purpose.

The provided bypass line allows continuous emptying of the freshwater tank 2 to be performed upon reaching a predetermined fill level in the wastewater tank 1 via the provided solenoid valve 12.

The invention claimed is:

1. A sanitary system for a rail vehicle, the sanitary system comprising:

a wastewater tank of a sanitation unit for receiving wastewater;

a freshwater tank of said sanitation unit for receiving freshwater;

fill level sensors, at least one of said fill level sensors associated to each of said wastewater tank and said freshwater tank; and a control device controlling fill levels in said freshwater tank and said wastewater tank, said control device monitoring a fill level in said wastewater tank with an aid of at least one of said fill level sensors and, in dependence on a detected fill level in said wastewater tank, said control device controlling the fill level in said freshwater tank, said control device programmed to limit a freshwater level in said freshwater tank such that remaining freshwater in said freshwater tank can be accommodated in said wastewater tank.

2. The sanitary system according to claim 1, wherein said control device continuously monitors the fill level of said wastewater tank.

3. The sanitary system according to claim 1, wherein said control device cyclically monitors the fill level in said wastewater tank.

4. The sanitary system according to claim 1, wherein said control device monitors the fill level in said wastewater tank upon reaching a predetermined limiting value.

5. The sanitary system according to claim 1, further comprising filling lines connected to said freshwater tank, said control device closing off said filling lines of said freshwater tank upon reaching a predetermined fill level in said wastewater tank.

6. The sanitary system according to claim 5, further comprising a filling stop socket connected in said filling lines, the closing off of said filling lines is performed by activating said filling stop socket in each case.

7. The sanitary system according to according to claim 5, further comprising solenoid valves disposed in said filling lines, the closing off of said filling lines is performed by activating said solenoid valves in said filling lines.

8. The sanitary system according to claim 1, further comprising an outlet line connected to said freshwater tank, said control device emptying said freshwater tank, in dependence on the fill level of said wastewater tank, via said outlet line.

9. The sanitary system according to claim 8, wherein said control device removes liquid in said freshwater tank to such a fill level that remaining freshwater can be accommodated by said wastewater tank.

10. The sanitary system according to claim 1, further comprising a display device, said fill level sensor of said wastewater tank is connected to said display device on a rail vehicle outer side and said display device outputs current status messages about the fill level of said wastewater tank.

11. The sanitary system according to claim 1, further comprising a diagnostic device, said fill level sensor of said wastewater tank is connected to said diagnostic device and signals current status messages about the fill level of said wastewater tank thereto.

* * * * *